US005464544A

United States Patent [19]

Berger

[11] Patent Number: 5,464,544

[45] Date of Patent: Nov. 7, 1995

[54] METHODS OF EXTINGUISHING ALKALI METAL FIRES WITH NON-AQUEOUS COMPOSITIONS

[75] Inventor: Paul H. Berger, Rome, N.Y.

[73] Assignee: Metro Fire & Rescue, Inc., Rome, N.Y.

[21] Appl. No.: 958,219

[22] Filed: Oct. 8, 1992

Related U.S. Application Data

[63] Continuation-in-part of Ser. No. 951,390, Sep. 25, 1992, Pat. No. 5,304,313, which is a continuation of Ser. No. 775,288, Oct. 11, 1991, abandoned.

[51] Int. Cl.[6] ..... A62D 1/00; A62C 1/00; B01F 17/42

[52] U.S. Cl. ..... 252/2; 252/3; 252/351; 169/47

[58] Field of Search ..... 252/3, 351, 364, 252/71, 2; 165/2; 169/47

[56] References Cited

U.S. PATENT DOCUMENTS

| | | | |
|---|---|---|---|
| 2,624,706 | 1/1953 | Maxcy et al. | 252/2 |
| 3,541,010 | 11/1970 | Dingman et al. | 252/3 |
| 3,578,590 | 5/1971 | Nieneker et al. | 252/8.05 |
| 3,772,195 | 11/1973 | Francen | 252/8.05 |
| 3,912,647 | 10/1975 | Adell | 252/8.05 |
| 4,090,967 | 5/1978 | Falk | 252/3 |
| 4,398,605 | 8/1983 | Conklin et al. | 252/3 |
| 4,476,687 | 10/1984 | Conklin et al. | 62/64 |
| 4,897,207 | 1/1990 | Greene | 252/2 |
| 4,904,398 | 2/1990 | Greene | 252/2 |

*Primary Examiner*—Richard D. Lovering
*Assistant Examiner*—Daniel S. Metzmaier
*Attorney, Agent, or Firm*—Whitham, Curtis, Whitham & McGinn

[57] ABSTRACT

Methods of extinguishing a fire in the presence of an alkali metal, such as lithium type fires, by contacting the fire with a mixture of different nonylphenolethoxylates with a non-aqueous solvent.

1 Claim, 1 Drawing Sheet

METHODS OF EXTINGUISHING ALKALI METAL FIRES WITH NON-AQUEOUS COMPOSITIONS

This is a continuation-in-part of the application Ser. No. 07/951,390 filed Sep. 25, 1992, now U.S. Pat. No. 5,304, 313, issued Apr. 19, 1994, which is a continuation of Ser. No. 07/775,288 filed Oct. 11, 1991, now abandoned.

FIELD OF THE INVENTION

The invention proposes a new approach to understanding the working of chemical formulations to increase radically their effectiveness when sprayed by conventional fire-fighting equipment to extinguish fires, even when well-fueled, and to cool rapidly surfaces of structures that have been heated by such fires to very elevated temperatures. Oil-well fires and their associated structures provide classic examples of a field of use for such formulations. The formulations are also effective against lithium type fires. The new approach referred to is to have the solute specially compounded to increase its fire and heat control effects through providing photo-excitable molecules. The fire is sprayed with the formulation until the desired result of cooling a hot surface or extinguishing a fire is obtained.

BACKGROUND OF THE INVENTION

The direct background of the present invention is found in two prior art patents to Conklin and Mowry, U.S. Pat. Nos. 4,398,605 and 4,476,687. The first is entitled "Fire Extinguishing Composition and Method"; the second, "Cooling Metal Surfaces." Their stated objectives are those of the present invention: "* * * a fire-fighting liquid that extinguishes a fire quickly and, in particular, cool[s] the fire so that the high heat generated is rapidly reduced." ('605 patent, col. 1, lines 45–48); * * * the provision of a heated surface cooling solution and method for cooling metal surface particularly structural steel elements of a petroleum rig." ('687 patent, col. 1, line 67 to col. 2, line 2).

These two patents contain a clear discussion of the prior art relevant to their patentability which is here intended to be incorporated by reference, i.e.:

Dingman, U.S. Pat. No. 3,541,010;

Nieneker, U.S. Pat. No. 3,578,590;

Francen, U.S. Pat. No. 3,772,195;

Adell, U.S. Pat No. 3,912,647;

Falk, U.S. Pat. No. 4,090,967.

Practice of the present invention achieves a dramatic improvement over the results that can actually be obtained by practicing the methods described and claimed by Conklin and Mowry in their '605 and '687 patents. This improvement can be realized to its fullest extent by utilizing two different aspects of the discoveries that underlie it. The first is in the specific novel combinations of chemical components to be used to make up the water solution concentrate which is added by the fire fighters to the water to be sprayed. The second is in the different concentration of nonionic chemicals to be included in the ultimate fire-fighting and cooling solution sprayed which is twice the maximum in % by volume of that permitted by the Conklin and Mowry disclosures.

Thus, those disclosures state:

'605 patent, col. 5, lines 29–43:

"The fire fighting solution is formed from the concentrate solution in an amount such that the fire fighting solution contains between 0.02% to 0.2% by volume of the surfactant. Preferably, the fire fighting solution would have the surfactant in the concentration of between 0.03% to 0.1% by volume. When premixed from the concentrate to the specified concentration, the pump draws in the premixed fire fighting solution.

"Concentration of this surfactant in the fire fighting solution is important in enabling the fire to be extinguished very rapidly. It has been found that the low concentration enables the fire to be smothered or choked off by a cloud generated from the fire fighting solution. The fire is extinguished more rapidly than with any other fire fighting composition."

'687 patent, col. 4, lines 1–15:

"The cooling solution is formed from the concentrate solution in an amount such that the solution contains between 0.02% to 0.2% by volume of the surfactant. Preferably, the solution would have the surfactant in the concentration of between 0.03% to 0.1% by volume. When premixed from the concentrate to the specified concentration, the pump draws in the premised cooling solution.

"Concentration of this surfactant in the cooling solution is important in enabling the heat to be absorbed very rapidly from the metal surfaces. It has been found that the low concentration enables the heat to be absorbed by a cloud generated from the cooling solution so as to more rapidly cool the metal surfaces compared to any other liquid composition."

In the present invention, on the other hand, surfactant concentration in the fire fighting solution is to be not less than 0.2% and preferably about 0.3% by volume, based on present experience. The solution may contain solutes to a total of about 25% by weight.

SUMMARY OF THE INVENTION

The method of this invention uses a fire fighting and hot surface cooling surfactant mixture dissolved either in water or in a non-aqueous solvent, the mixture forming a concentrate which when sprayed contains more than 0.2% by volume of the surfactant. The concentrate differs from that of Conklin and Mowry in that it is comprised of one or more specific nonionic surfactants possessing a photoexcitable functional group and an aryl phosphate, also of a photoexcitable nature, in a solvent medium of composition and content that allows for convenient, workable viscosity and is resistant to the effects of freezing. A preferred spray solution will contain from 2000 ppm of the surfactant, nonylphenolethoxylate, and 94 ppm of the aryl phosphate, poly(oxy-1, 2-ethanoliyl), a-phenol-ω-hydroxy-(2)-phosphate to 3000 ppm surfactant and 141 ppm aryl phosphate.

GENERAL DESCRIPTION

Figure 1:
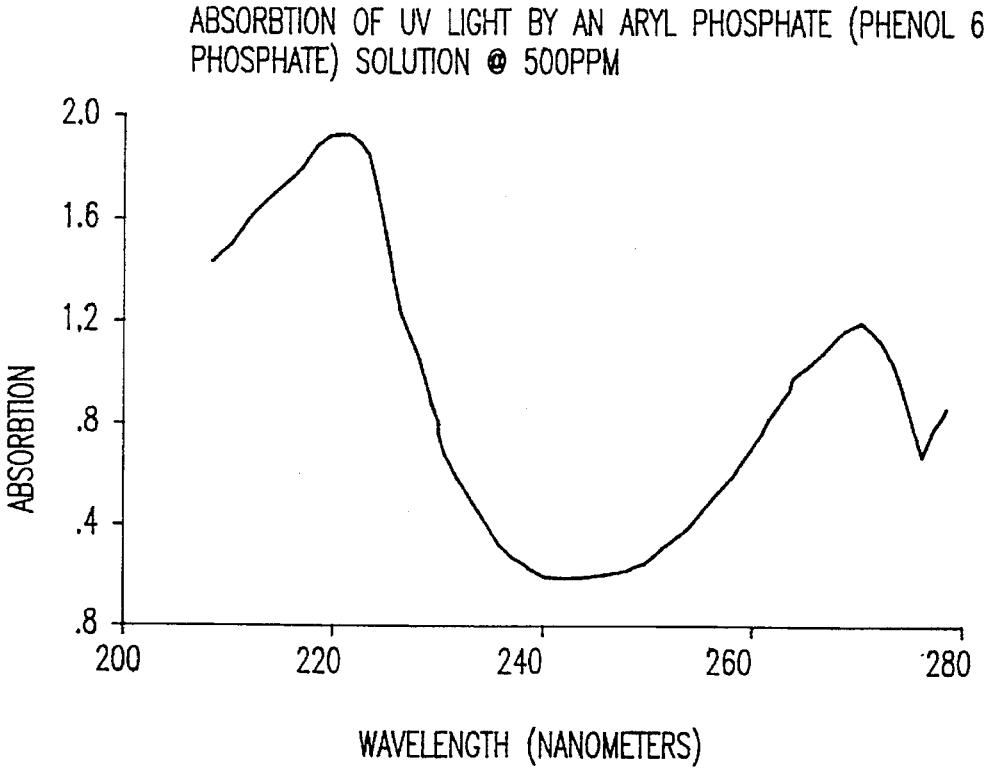
FIG. 1 is a plot of the spectral absorption qualities of ultra violet light by a 500 ppm water solution of the aryl phosphate poly(oxy-1,2-ethandiyl), a-phenol-ω-hydroxy-(2)-phosphate.

In common fire control terminology combustible materials are often referred to as Class A and Class B. Class A materials are ordinary combustible solids and include wood, cotton, paper, and the like; Class B materials are inflammable liquids and include gasoline, benzene, and other liquid hydrocarbons. Fires involving these materials are conveniently referred to as Class A and Class B fires. They can be described as chaotic oxidation of numerous classes of organic compounds. The chemical yield of such reactions is equally chaotic and includes many classes of organic compounds in addition to $H_2O$, $CO_2$, and CO. Important in understanding the present invention is to keep in mind the common denominator of all combustion reactions, namely, that the products yielded are at a much lower total Gibbs free energy state than the fuel reactants. In the process of achieving this lower energy state a great photon yield of radiant energy is delivered. This is evidenced by the various colors and wave lengths present with flame emissions.

The flame emission line for carbon is at 248.35 nm. The Balmer series of emission lines for hydrogen range from the red at 656.3 nm through the blue-green at 486.2 nm, blue at 434.1 nm, and ending at the ultra violet at 364.6 nm. The Lyman series of emission lines occur in the far ultra violet beginning at 121.6 nm and ending at 91.2 nm. These emissions, by striking the fuel load directly and by striking adjacent bodies that reradiate, are responsible for propagating the violent sets of reactions present in the combustion of organic materials. Following the methods of this invention interferes with these reactions by providing a continuous stream of molecules that will absorb the high energy radiant emissions from the combustion process. These molecules are of such structure that they will absorb a photon, elevate to an excited state, and revert to the ground state within a period of $10^{-3}$ to $10^{-8}$ seconds. Thus, the compositions of the invention may be described as agents that will absorb high energy photons emitted during combustion.

A formulation used in the method of this invention comprises water as the solvent, containing as solute the active materials, i.e., the prescribed concentrations of the compositions just described, e.g., nonylphenolethoxylate and the aryl phosphate, poly(oxy-1,2-ethandiyl), a-phenol-ω-hydroxy-(2)-phosphate. The solute components are dissolved, typically in water, to form the concentrate solution in which the composition is usually sold and shipped. This concentrate usually has about 25% by weight of the active material solutes. The concentrate is fed into the spray water by the fire control personnel using conventional pumping equipment to produce a spray solution containing more than 0.2%, preferably about 0.3%, solutes by volume.

DETAILED DESCRIPTION

Various objects and advantages of the invention are achieved by a composition of matter, comprising agents that have molecules that rapidly absorb high energy radiant emission produced during combustion, said agents comprising a mixture of nonionic surfactant(s) and other components as necessary, in such amounts in a solution that said solution extinguishes a fire or cools a hot surface efficiently and quickly.

Figure 2:
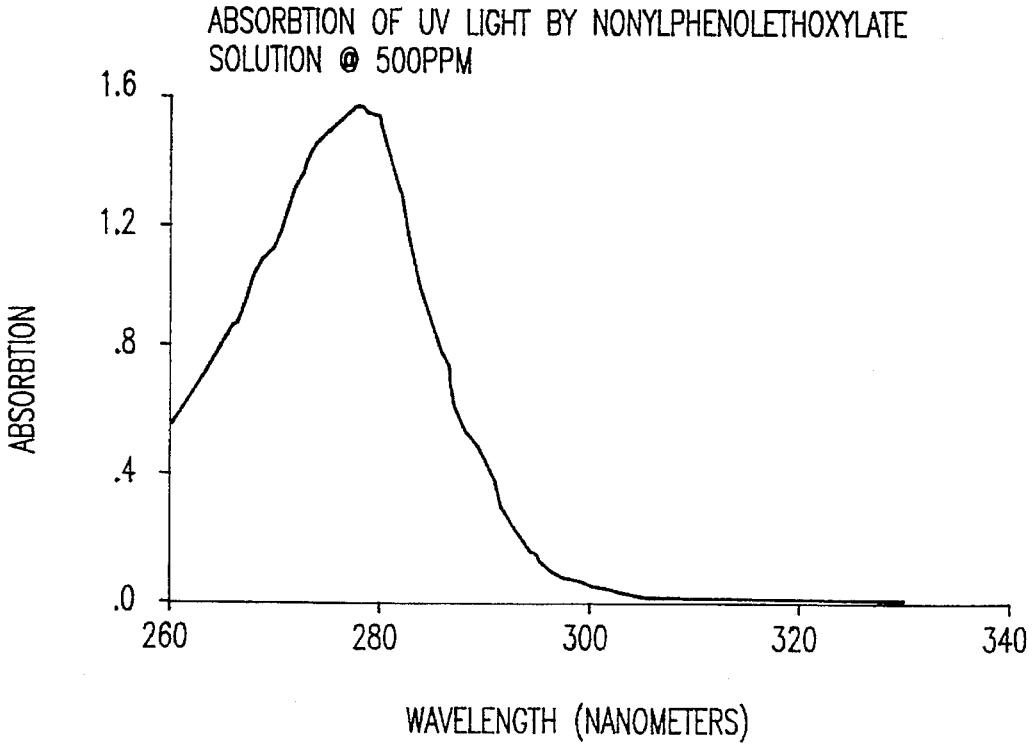
FIG. 2 is a plot of the spectral absorption qualities of ultra violet light by a 500 ppm water solution of nonylphenolethoxylate.

Without being bound to any specific theory, it is postulated that the present invention works by providing an agent that will absorb the high energy photons that are emitted during combustion, such agents being designated herein as agents containing photoexcitable functional group. Once absorbed in the Pi electron structure of the aryl functional group, this energy is reradiated as the Pi electrons return to the ground state, at a longer wave length, since that structure is not a perfect blackbody. Being of longer wave length and lower energy, the reradiant photons are not of sufficient energy levels to propagate the violent combustion reactions. The aryl phosphate, poly(oxy-1,2-ethandiyl), a-phenol-ω-hydroxy-(2)-phosphate has been found to have complimentary spectral absorption qualities (FIG. 1) to that of nonylphenolethoxylate (FIG. 2), and has a stabilizing electronic configuration in the phospho-enol functional group. Compositions employing photon capture technology according to the present invention comprise various concentrations. In the following example, it was found that 3000 ppm of nonylphenolethoxylate and 141 ppm of the aryl phosphate, poly(oxy-1,2-ethandiyl), a-phenol-ω-hydroxy-(2)-phosphate in the spray allowed an extremely difficult fire to be extinguished in outstandingly short time. Liquid propane at its own vapor pressure, ambient temp 90° F., was flowed through a 0.5" diameter line to a 1.5" diameter "Christmas Tree" structure comprised of 3 flange connected valves with leaking flanges and ignited. When the resulting fire had fully evolved, flames reached 30 feet and infrared temperature readings from the steel pipe exceeded 1400° F. A water spray containing 3000 ppm of nonylphenolethoxylate and 141 ppm of the aryl phosphate, poly(oxy-1,2-ethandiyl), a-phenol-ω-hydroxy-(2)-phosphate extinguished the fire in 4 seconds; all attempts using water alone failed.

It is noted that a preferred concentrate for convenient field introduction into a water stream may contain about 25% of the active material, 5% propylene glycol monobutyl ether, 5% mixed isopropanol amine borate (MIPA:Borate), about 0.1% 1,2,benzisothiazoline-3-one and the balance water. It is pointed out that a water solution of the active material alone freezes at 32° F. and has a viscosity of 1100 centipoise at 60° F. The 5% propylene glycol monobutyl ether provides a freezing point at 24° F. and a viscosity of about 110 centipoise at 60° F. The 5% MIPA:Borate and the 0.1% 1,2,benzisothiazoline-3-one are to provide shelf life extension. Of course, as is well known to one of ordinary skill in the art, several preservatives, antifreeze and viscosity controlling materials, other than those mentioned above are commonly known in the industry and suitable substitutions can be easily made in the formulations described herein.

Another embodiment of the present invention comprises a nonaqueous mixture for fighting those types of fires where conventional fire fighting methods are found to be unsafe. For example, fires that may be caused in systems that employ lithium, e.g. in stored chemical energy propulsion systems, water or other extinguishing agents that contain halocarbon agents or fluorocarbon surfactants in foam forming compositions cannot be used, because lithium is a highly reactive alkali metal. The present invention, therefore, provides a non-aqueous composition where the non-aqueous solvent or medium may be propyleneglycol monobutylether, propylene-glycol methyl ether, dipropylene-glycol methyl ether, propylene carbonate and the like. A non-aqueous composition may be prepared as follows:

Nonylphenolethoxylate (9 mole ratio ethylene oxide to nonylphenol) 92.6% wt.;

Nonylphenolethoxylate (1.5 mole ratio) 6.2% wt.;

Propylene glycol t-butyl ether 1.2% wt.

The composition successfully extinguishes lithium type fires.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the methods and materials described herein are preferred. Unless mentioned otherwise, the techniques employed or contemplated herein are standard methodologies well known to one of ordinary skill in the art. The materials, methods and examples are only illustrative and not limiting.

It is understood that the embodiments described herein are only exemplary and that various modifications or changes in light thereof will be suggested to persons skilled in the art and are to be included within the spirit and purview of this application and scope of the appended claims.

I claim:

1. A method of extinguishing a fire in the presence of an alkali metal, comprising the step of contacting a fire in the presence of an alkali metal with a non-aqueous fire fighting composition which includes a mixture of nonionic surfactants including at least one nonylphenolethoxylate nonionic surfactant, and an organic solvent.

* * * * *